US007845871B2

(12) United States Patent
Thiebaut

(10) Patent No.: US 7,845,871 B2
(45) Date of Patent: Dec. 7, 2010

(54) PACKAGING AND DISPENSING DEVICE FOR TWO PRODUCTS

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 1245 days.

(21) Appl. No.: 11/402,940

(22) Filed: Apr. 13, 2006

(65) Prior Publication Data

US 2006/0233590 A1 Oct. 19, 2006

Related U.S. Application Data

(60) Provisional application No. 60/674,291, filed on Apr. 25, 2005.

(30) Foreign Application Priority Data

Apr. 15, 2005 (FR) ..... 05 50961

(51) Int. Cl.
*B05C 1/00* (2006.01)

(52) U.S. Cl. ..... 401/17; 401/18; 401/126; 132/317; 132/314

(58) Field of Classification Search ..... 401/16–18, 401/36, 52, 23, 24, 118, 119, 121, 123–130; 132/314, 317, 315, 318, 293–295, 313; 206/581, 206/515

See application file for complete search history.

(56) References Cited

U.S. PATENT DOCUMENTS

| | | | | |
|---|---|---|---|---|
| 5,509,742 | A * | 4/1996 | Balzarini | 401/17 |
| 5,848,731 | A | 12/1998 | Deering | |
| 5,850,919 | A | 12/1998 | Freed | |
| 5,897,262 | A * | 4/1999 | Bratby-Carey | 401/18 |
| 6,276,853 | B1 * | 8/2001 | Breidenbach et al. | 401/18 |
| 6,450,179 | B2 * | 9/2002 | Bengis | 401/18 |
| 6,464,418 | B1 * | 10/2002 | Visser et al. | 401/18 |
| 6,612,764 | B2 * | 9/2003 | Dumler et al. | 401/18 |
| 6,637,963 | B2 * | 10/2003 | Huang | 401/18 |
| 6,655,391 | B2 * | 12/2003 | Sunago | 401/17 |
| 6,702,494 | B2 * | 3/2004 | Dumler et al. | 401/18 |
| 7,226,227 | B2 * | 6/2007 | Gueret | 401/18 |
| 2004/0190974 | A1 | 9/2004 | Cantone et al. | |

FOREIGN PATENT DOCUMENTS

| | | |
|---|---|---|
| DE | G 93 03 428.8 | 6/1993 |
| DE | 201 10 778 | 9/2001 |
| EP | 1 000 607 | 5/2000 |
| EP | 1 378 188 | 1/2004 |
| EP | 1 382 541 | 1/2004 |

* cited by examiner

*Primary Examiner*—Gregory L Huson
*Assistant Examiner*—Keegan Gumbs
(74) *Attorney, Agent, or Firm*—Oblon, Spivak, McClelland, Maier & Neustadt, L.L.P.

(57) ABSTRACT

A packaging and dispensing device includes a container holding a first product, and a closure capsule including a base part configured to detachably close off the container. The device includes a recess defined in a mobile part of the closure capsule, this recess containing a second product. An opening in the recess is closed off by a cap, such that the mobile part can assume, relative to the base part, a closed position wherein the cap is rendered inaccessible by the base part, and an open position wherein the cap is accessible.

26 Claims, 3 Drawing Sheets

Fig. 10
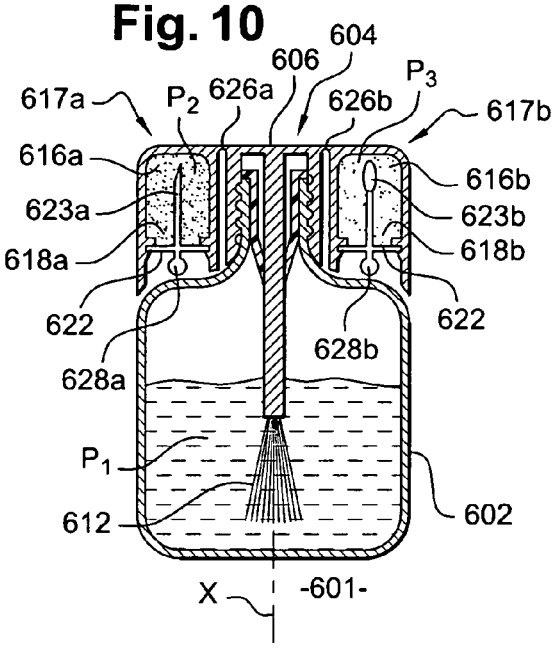
Fig. 11
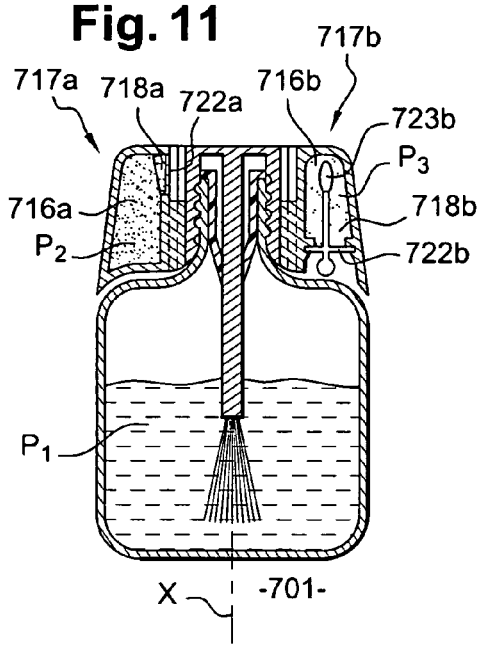
Fig. 12
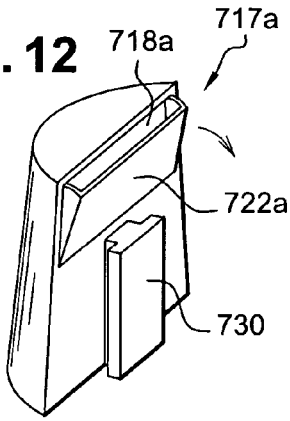
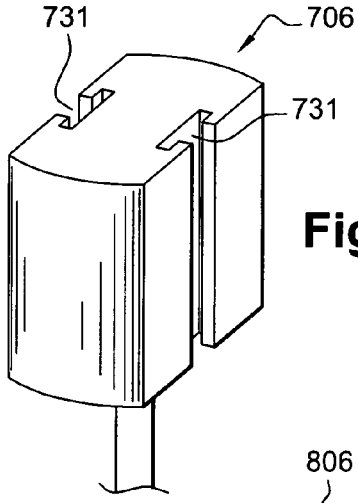
Fig. 13
Fig. 14
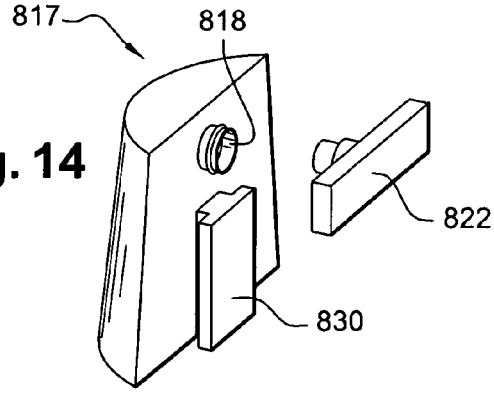
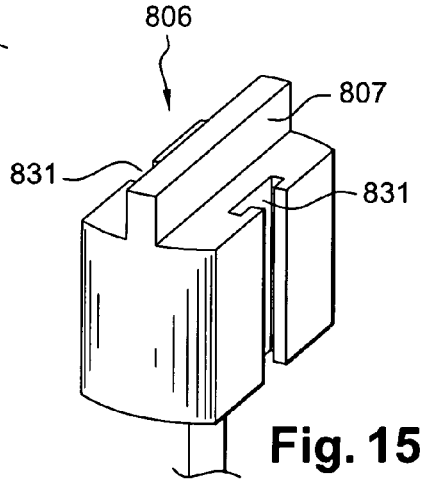
Fig. 15

PACKAGING AND DISPENSING DEVICE FOR TWO PRODUCTS

CROSS-REFERENCE TO RELATED APPLICATIONS

This document claims priority to French Application Number 05 50961, filed Apr. 15, 2005 and U.S. Provisional Application No. 60/674,291, filed Apr. 25, 2005, the entire contents of which are hereby incorporated by reference.

BACKGROUND OF THE INVENTION

1. Field of the Invention

The invention relates to devices for packaging and separate dispensing of at least two products, in particular two cosmetic or skin care products.

2. Discussion of Background

The expression "cosmetic product" is understood to mean a product as defined in EC Council Directive 93/35/CEE dated 14th Jun. 1993.

From the teaching of document EP-1378188, a coupling element is known that allows the assembly of two self-contained devices for separate packaging and application of cosmetic products.

Document US-2004-190974 also describes a known device comprising two assembled containers. The first container presents a first opening closed off by the bottom of the second container. The second container also includes a second opening closed off by a closure capsule. The two containers are stacked one on top of the other. In effect, when this assembly is resting with the bottom of the first container on a flat surface, the products respectively contained in the first and second container remain, by virtue of gravity, respectively in the bottom of each of these containers.

European patent application EP-A-1382541 also describes a known device for separate packaging of two products comprising a container holding a first product and closed off by a closure capsule. This closure capsule includes a base portion presenting on one hand attachment means to enable the container to be closed off, and a recess containing a second product on the other hand. This recess is closed off by a part of the capsule that is mobile relative to the base portion. In this case also, the products respectively contained in the container and the recess stabilise at the bottom of their respective containing space.

There is a need to provide a simple means to make it possible to generate a flow of product in at least one of the container and/or the recess provided in the closure capsule of such devices, without thereby substantially modifying the actions required to manipulate these devices during successive application of the products respectively contained therein.

Document EP-1000607 describes a known method for applying make-up to the eyelashes consisting of the successive application of two products, the first product applied being a film-forming composition and the second product applied comprising solid particles sprinkled onto a layer of this film-forming composition before the latter has dried.

SUMMARY OF THE INVENTION

The invention discloses a packaging and dispensing device which at least partially resolves the problem described above. According to a preferred embodiment, the device includes a container holding a first product, and a closure capsule including a base part configured to detachably close off the container. The device can include a recess defined in a mobile part of the closure capsule, this recess containing a second product. An opening in the seating can be closed off by a cap, such that the mobile part can assume, relative to the base part, a closed position wherein the cap can be rendered inaccessible by the base part, and an open position wherein the cap is accessible.

The cap can be rendered inaccessible by the base part, such that direct manual grasping of the cap can be prevented by the base part at least. According to a preferred embodiment of the invention, grasping of the cap can be prevented by the base part exclusively, or by the base part and the container whereon it is mounted, when it is mounted on the latter so as to close it off.

The mobile part of the closure capsule is mobile relative to the base part of this capsule.

The device can include a first applicator designed to be held in the volume delineated by the container and the base part, when the container is closed by the base part.

The device can include a second applicator, such that the recess can be configured to contain it. This second applicator can be carried by the cap.

The mobile part can be connected by a film hinge to the base part, and can be made of plastic in one piece with the mobile part. Alternatively, the mobile part can be detachable relative to the base part.

The cap can be connected by a film hinge to the mobile part. In this case, the base part, the mobile part and the cap can optionally be manufactured together in a single piece made of plastic. Alternatively, the cap can be detachable relative to the mobile part.

The cap can include a seal to close the recess in a leaktight manner. In particular, it can include a sealing lip.

The second product can be fluid, and in particular powder or liquid.

The cap can include grasping means to facilitate handling of the cap, this grasping means being concealed between the base part and the mobile part when the closure capsule is in the closed position. In particular, this grasping means can form a lug projecting beyond a face of the cap opposite that facing the recess.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood by reading the following description and by reference to the accompanying figures. These are given for guidance only and are in no way limitative of the invention. The figures show:

FIG. 10: a lengthwise sectional view of a seventh embodiment of a device according to the invention in the closed position;

FIG. 11: a lengthwise sectional view of an eighth embodiment of a device according to the invention in the closed position;

FIG. 12: a perspective view of a mobile part of the closure capsule of the device illustrated in FIG. 1;

FIG. 13: a perspective view of the base part of the closure capsule of the device illustrated in FIG. 11;

FIGS. 14 and 15: perspective views of a variant of a mobile part and a base part of a closure capsule.

DETAILED DESCRIPTION OF THE PREFERRED EMBODIMENTS

Figure 1:
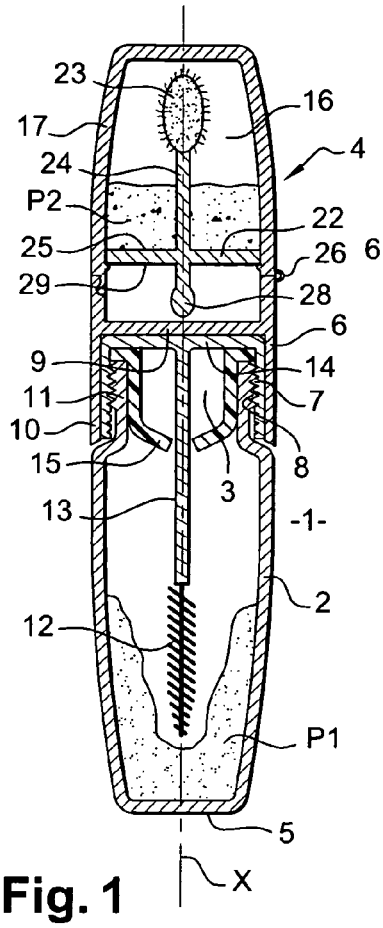
FIG. 1: a lengthwise sectional view of a first embodiment of a device according to an embodiment of the invention in the closed position.

FIG. 1 shows a device 1 according to a preferred embodiment of the invention. The device 1 includes a container 2 holding a first product P1 and presenting an opening 3 for dispensing this first product P1. In FIG. 1, the opening 3 is closed off by a closure capsule 4.

The container 2 can be made of glass or a thermoplastic material. It can have transparent walls enabling the level of product P1 remaining in the container 2 to be checked.

The container 2 has a lengthwise axis X. In the examples shown and particularly in FIG. 1, the axis X extends perpendicularly to a bottom 5 whereon the container 2 can stand on a flat surface. The opening 3 can be defined in a plane parallel to the bottom 5.

The closure capsule 4 includes a base part 6 presenting attachment means 7 counterpart to attachment means 8 presented on the outer surface of the container 2. The base part 6 can in particular be configured to attach to the container 2 by screwing, snap action or friction. The attachment means 7 and 8 can respectively include a screw thread, a projection designed to allow snap attachment, in particular a groove or an annular bead, or again a part designed to engage with the container 2 by friction.

In particular, in FIG. 1, the base part 6 includes a support 9 from which extends a skirt 10 presenting the attachment means 7 to engage with the attachment means 8 presented on the neck 11 of the container 2. The support 9 can be designed to make leaktight contact with a rim of the opening 3.

In the embodiment shown in FIG. 1, the base part 6 includes a first applicator 12 projecting beyond the support 9, and extending at least partially inside the container 2 when the closure capsule 4 is closing off the opening 3. In particular, this first applicator 12 is mounted at the end of a rod 13 standing perpendicular to the support 9.

As shown in FIG. 1, the rod 13 projects from a fitted rod holder 14 held in place by cooperation with the skirt 10, this rod holder 14 presenting the attachment means 7. This rod holder 14 can be designed to make leaktight contact with a rim of the opening 3, where appropriate. Again according to this embodiment, the first product P1 can be a cosmetic composition, such as a mascara, designed to be applied to keratinic fibres. The first applicator 12 can be configured for such an application and can take the form of a bristled wand. For this purpose, the neck 11 is fitted with a wiper element 15 designed to cooperate with the brush so as to calibrate the quantity of product presented on the wand at each application.

The device 1 according to the invention enables make-up to be applied, in a first stage by applying the first product P1, and in a second stage by applying a second product P2. For this purpose, the closure capsule 4 includes a recess 16 defined in a mobile part 17 of this capsule 4. This part 17 is said to be mobile as it can be moved relative to the base part 6 of the capsule.

In the example shown in FIG. 1, the mobile part 17 is connected to the base part 6 on a side opposite that from which the fixing skirt 10 projects. It is in particular mounted on this base part 6 in such a way that the base part 6 is designed to conceal an opening 18 affording access to the recess 16. The part 17 being mobile, it is configured to be capable of moving from this first so-called "closed" position wherein access to the recess 16 is concealed to a second so-called "open" position wherein the opening 18 in the recess 16 is accessible.

To maintain the closed position, the mobile part 17 can be configured to be held in position on the base part 6 by screwing, snap attachment or friction. In the example shown in FIG. 2, the mobile part 17 presents a resiliently deformable tongue 19 designed to snap into a counterpart groove 20 on the inner surface of a second skirt 21 projecting from the support 9 in a direction opposite that of the first skirt 10.

When the user wishes to apply the first product P1, the base part 6 and the mobile part 17 are preferably held in the closed position to form an element for grasping and manipulation of the first applicator 12.

To apply the second product P2, the base part 6 is preferably mounted on the container 2 thereby facilitating handling, and the mobile part 17 is moved from the "closed" position to the "open" position thereby rendering the opening 18 accessible. In effect, the opening 18 is closed off by a cap 22, such that in the "closed" position the cap 22 is inaccessible, concealed by the base part 6, between the base part 6 and the mobile part 17, whereas in the open position the cap 22 is accessible so that it can be removed from the opening 18. The user then removes said cap 22 and takes up a quantity of the second product P2. The second product P2 can be applied on the same area, over the first product P1, or it can be applied on an area separate from that on which the first product P1 has already been applied.

The cap 22 is configured to be held in position by screwing, snap attachment or friction on the mobile part 17 thereby closing off the opening 18 in the recess in the "open" and "closed" positions respectively.

To facilitate application of this second product P2, the device 1 can include a second applicator 23 designed specifically for application of the second product P2.

In particular, this second applicator 23 can be configured to extend into the recess 16. It can also be held on the cap 22 so that the latter forms a means of grasping the applicator 23.

Figure 2:
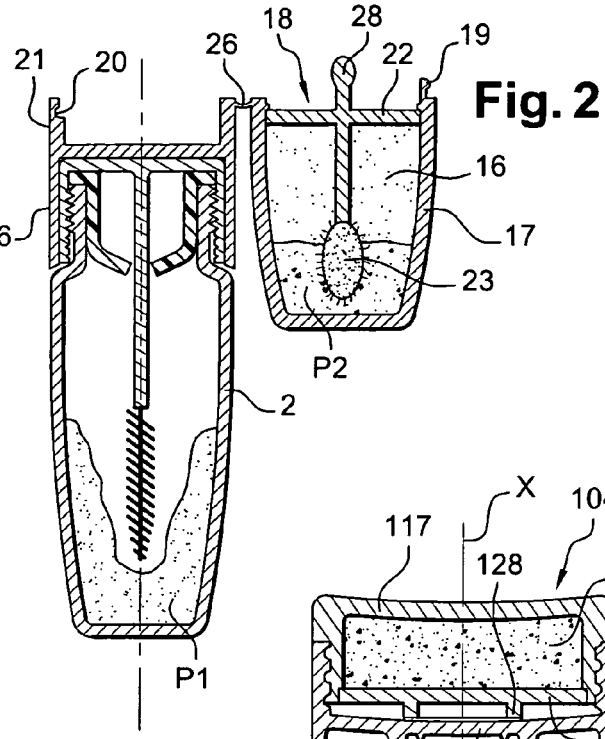
FIG. 2: a lengthwise sectional view of the device according to FIG. 1 in the open position.

In the example shown in FIGS. 1 and 2, the second product P2 is a powder and includes solid bodies such as flakes and/or pigments, for example mother-of-pearl, and the second applicator 23 takes the form of a resiliently deformable element made of flock-covered foam for example. This element 23 is in particular presented at the end of a second rod 24 projecting from a face 25 of the cap 22, the face 25 being disposed facing the inside of the recess 16 when the cap 22 is closing off this recess 16.

With a device according to the embodiment depicted in FIGS. 1 and 2, the user can make up her eyelashes starting with application of the first product P1 using the first applicator 12, and before the product P1 thus applied has fully dried on the eyelashes she applies the second product P2 so that it is held on the eyelashes by the first product.

In particular when the second product P2 is fluid and in particular powder, it tends to agglomerate during storage and to form clusters substantially larger than the size of the particles the user wishes to apply. It then becomes difficult for the user to correctly apportion the quantity of the second product to be applied. By the fact that the recess 16 is provided in the mobile part 17 of the closure capsule 4, when the user moves the capsule to the open position, she holds the container 2 closed off by the base part 6 in one hand, and the mobile part 17 is caused to rotate relative to this base part 6. The movement from the closed position to the open position thus generates a flow of product in the recess 16 by virtue of the movement imparted to the mobile part 17 and by gravity.

Similarly when the second product P2 is fluid and in particular liquid, it can be designed to be applied by means of the second applicator 23. After several applications, the level of product remaining in the recess does not necessarily ensure that the second applicator is immersed in the second product. The fact of causing the mobile part 17 to move relative to the base part 6 generates a flow of product in the recess, which improves the contact between the second product and the second applicator.

Figure 3:
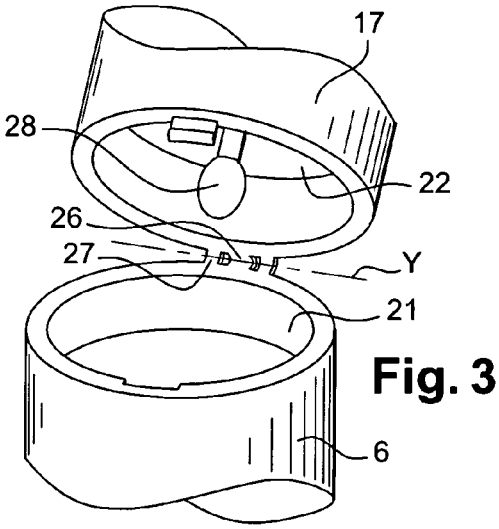
FIG. 3: a profile view of a closure capsule according to an embodiment of the invention in an open position.

In effect, in the embodiment depicted in FIGS. 1 and 2, the mobile part 17 is connected by a hinge 26 to the base part 6. In particular this hinge 26 is of the film-hinge type as shown in FIG. 3, the base part 6 and the mobile part 17 then being made in one piece by moulding. The mobile part 17 can be caused to rotate about an axis Y passing through this hinge.

The axis of rotation Y is preferably orthogonal to the lengthwise axis X. Thus, in the closed position the mobile part 17 is disposed on the base part 6 such that the opening 18 is perpendicular to this lengthwise axis X, and such that a lengthwise axis of the closure capsule 4 is substantially superimposed on the lengthwise axis X. In moving from the closed position to the open position, the mobile part 17 is caused to rotate through 180°, the base part 6 and the container 2 being held so that the axis X is oriented perpendicularly to the horizontal. In the open position, the mobile part 17 is bought to a position beside the base part 6 such that an edge delineating the mobile part extends in the same plane as the edge delineating the second skirt 21.

In the open position, the opening 18 in the recess faces upwards, and the second product is at no risk of flowing out of the recess 16 by gravity, even if the cap 22 is removed.

In the closed position, the opening 18 faces downwards, if the opening 3 in the container 2 is oriented upwards. As can be seen in the non-limiting embodiment of FIGS. 1-2, in the closed position, when the device 1 rests with the bottom 5 of the container 2 on a flat surface, the bottom 5 of the container 2 is positioned below the opening 3 defined by the neck of the container 2, and the bottom (unnumbered) of the container 17 is positioned above the opening 18 of the container 17 and the cap 22. In the open position shown in FIG. 2, the bottom of the container 17 has now moved to a position below the opening 18 of the container 17 and the cap 22.

As seen in FIG. 1, in the closed position, the container 2 and the container 17 are aligned along the longitudinal axis X of the device 1 such that the bottom 5 of the container 2, the cap 9 closing the opening 3, the cap 22 closing the opening 18, and the bottom of the container 17 are aligned successively along the longitudinal axis. In the open position shown in FIG. 2, the containers 2 and 17 are not aligned along the longitudinal axis. In this open position, the caps 9 and 22 are exposed, i.e. they are not enclosed in a cavity, as in the closed position shown in FIG. 1.

The film hinge 26 between the container 2 and the container 17 can be a spring-effect hinge to facilitate and accelerate the movement from the closed position to the open position and vice-versa. In this case, the film hinge 26 then includes at least one connecting strip 27 connecting the base part 6 to the mobile part 17 such that this connecting strip 27 passes through a position of optimum tension or compression when the mobile part 17 is moved relative to the base part 5.

The cap 22 can be made detachable relative to the mobile part 17. Alternatively, it can also be connected to this mobile part 17 via a hinge of the film-hinge type.

To facilitate the fitting and removal of the cap 22 relative to the mobile part, the cap 22 includes a grasping means 28. The grasping means projects from a face 29 of this cap opposite the face 25 disposed towards the recess 16. The grasping means can take the form of a stud standing perpendicular to the face 29. In the closed position, the grasping means 28 extends into a space situated between the cap 22 and the support 9, this space being at least partially delineated laterally by the second skirt 21 of the base part 6.

As a variant, as illustrated in FIGS. 4 to 15, the different elements of the device according to the invention are numbered with a corresponding hundred prefix relative to the identical elements of the first embodiment.

Figure 4:
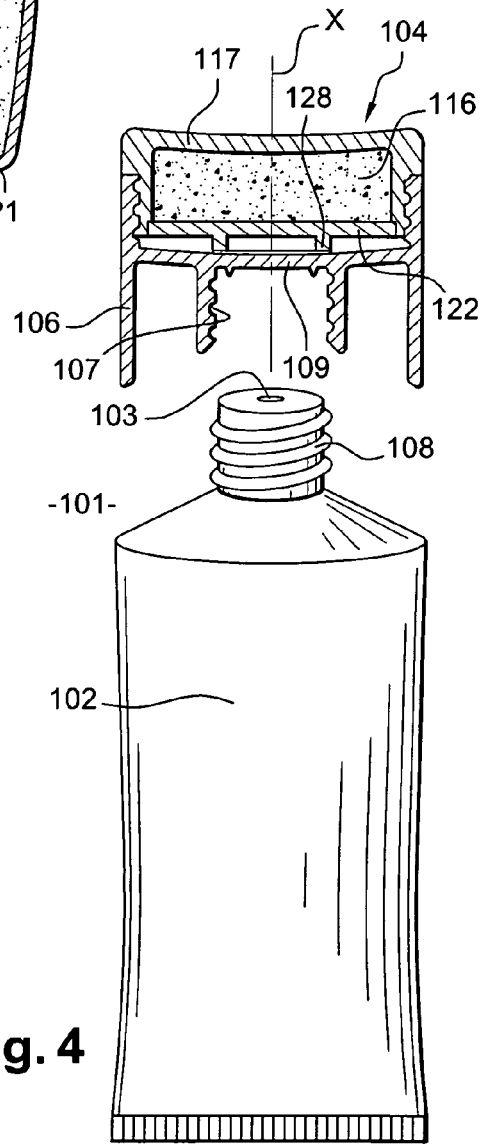
FIG. 4: a lengthwise sectional view of a second embodiment of a device according to the invention, the closure capsule being in the closed position but nonetheless detached from the container.

In particular, the device 101 in FIG. 4 includes a container 102 which can take the form of a flexible-walled tube, such that a pressure exerted on the outer surface of these walls causes them to deform and to reduce the internal volume of this tube. The first product P1 contained in this tube can then be expelled from the opening 103 delineated by this tube and can be taken up by the user directly on the finger for example. In the embodiment shown in FIG. 4, the device 101 does not include a first applicator. Opening and closing of the closure capsule 104 on the tube is accomplished in particular by screwing the provided attachment means respectively 107 and 108.

Furthermore, in this embodiment, the mobile part 117 is detachably screwed onto the base part 106, so that the movement from the closed position to the open position is obtained at least by rotating the mobile part 117 relative to the base part 106 about the lengthwise axis X. During this unscrewing action, the flow created in the recess 116 is centrifugal. In addition, when the mobile part 117 has been unscrewed, it must be turned over to enable the user to gain access to the grasping means 128 in order to remove the cap 122. In turning over the mobile part 117, a flow of product P2 is also generated in the recess 116.

In an embodiment according to the invention illustrated in particular in FIG. 4, the device need not have a second applicator for the second product. The second product can also be taken up by the finger directly from the recess 116 when the cap 122 has been removed. According to FIG. 4, the cap 122 is held by friction against an inner surface of the mobile part 117 delineating the recess 116. In the closed position, the grasping means 128 abuts against a face of the support 109.

The applicator or applicators provided in a device such as 1 according to the invention can have a variety of surface textures and shapes, and the application surface of these elements can for example present a generally outwardly convex shape.

In other alternative embodiments, these applicators such as 12 and/or 23 can be porous. They can include, for example, an open-cell or closed-cell foam. They can be compressible, incorporating, for example, a resiliently deformable material such as a foam of polyurethane, polyester, polyether, PVC, NBR, or a felt; they can also be made of a non-compressible material such as an agglomerate material, for example an agglomerate of polyethylene, PVC, EVA, polyamide, or brass. In particular, when the applicator includes a non-porous material, deformable or otherwise, it can be perforated with at least one aperture to allow the product to pass through.

The applicators according to the invention can include, externally, a skin made of an impermeable material and traversed by at least one aperture allowing the first product to pass through. The application surface of said applicator can also be defined, for example, by a woven fabric, a non-woven fabric, a mesh, or a leather material. The applicators 12 and/or 23 can include several layers of different types.

The applicators according to the invention can also take the form of a bristle brush, a comb, a pencil brush, a pad, or a resiliently deformable tip, optionally flock-covered.

Figure 5:
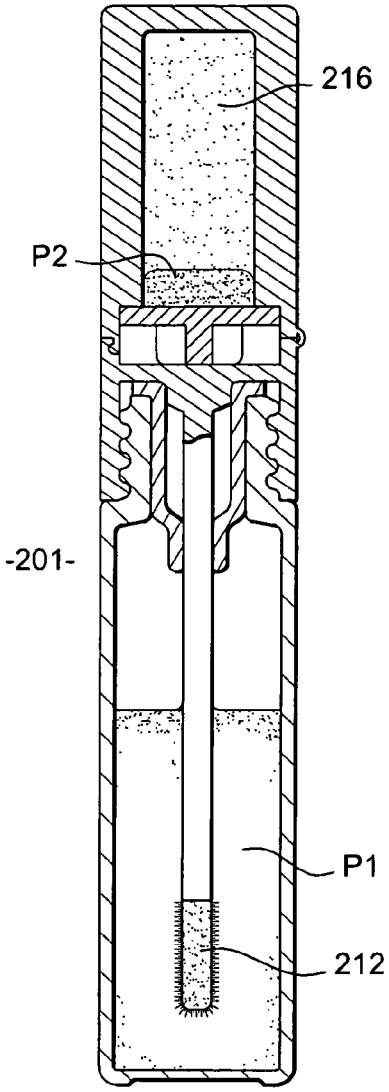
FIG. 5; a lengthwise sectional view of a third embodiment of a device according to the invention in the closed position.

In particular, in the embodiment of the device 201 according to the invention illustrated in FIG. 5, being a variant of the embodiment depicted in FIG. 1, the first applicator 212 can take the form of a porous flock tip, the first product P1 preferably being liquid, and the device 201 according to this variant does not include a second applicator.

Figure 6:
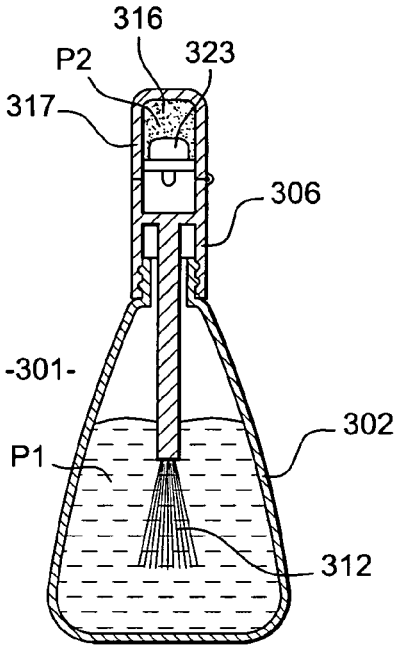
FIG. 6: a lengthwise sectional view of a fourth embodiment of a device according to the invention in the closed position.

In the embodiment of the device 301 according to the invention illustrated in FIG. 6, the first product P1 is a nail varnish, and the second product P2 takes the form of flakes. In this case, the first applicator can take the form of a pencil brush 312, and the second applicator can take the form of a pad 323. The pad incorporates a pattern designed to take up a thin surface film of flakes.

Figure 7:
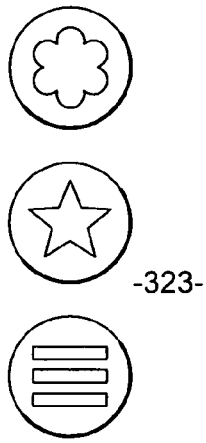
FIG. 7: top views of alternative embodiments of a cap according to the invention.

FIG. 7 illustrates different patterns that can be presented in particular by the pad 323. Such a device makes it possible in particular to apply a layer of varnish onto the nails and then, using the pad, to apply a pattern of flakes onto the varnish layer while it is drying, thereby holding the flakes in the varnish and creating an aesthetically pleasing effect.

Figure 8:
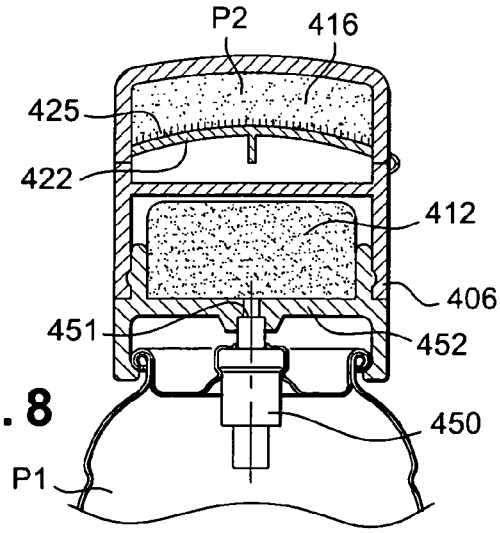
FIG. 8: a lengthwise sectional view of a fifth embodiment of a device according to the invention in the closed position.

In the embodiment of the device 401 according to the invention depicted in FIG. 8, the container 402 is an aerosol container, the first product P1 being held therein under pressure, and dispensing of the product can be accomplished by a valve 450 emerging into a porous body 412 disposed against an outlet aperture 451 of the valve 450 and serving as a first applicator. The first applicator 412 is concealed by the base part 406 of the closure capsule which is held by snap attachment on the support 452 of the porous body mounted on the body of the valve 450. In this case, the face 425 of the cap 422 oriented towards the inside of the recess 416 is covered by a film, for example of non-woven material, designed to form the second applicator 423.

Figure 9:
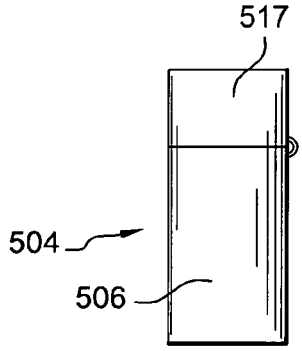
FIG. 9: a profile view of a sixth embodiment of a device according to the invention in the closed position.
Figure 9:
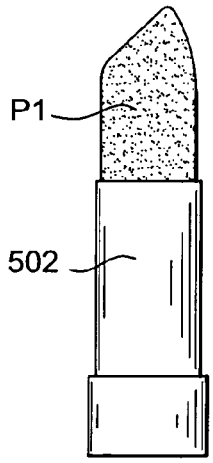

In the embodiment of the device 501 according to the invention depicted in FIG. 9, the first product can take the form of a bar mounted on a mobile element so as to be capable of being presented outside the container 502, this first product can take the form of a bar of lip colour for example. The closure capsule 504 is designed to be mounted on the container 502 when the product bar is retracted inside the container. The second product contained in the mobile part 517 can be designed to be applied on the lips, for example a lip gloss.

In the embodiment of the device 601 depicted in FIG. 10, the container 602 is in the form of a bottle containing a first product P1. It is closed by a capsule 604 which includes a base part 606, and in this instance two recesses respectively delineated by two mobile parts 617*a* and 617*b* respectively containing a second and a third product P2 and P3.

The base part 606 screws onto the neck of the container 602. It carries an applicator 612 at the end of a rod 613, for example in the form of a pencil brush, which is held in the container 602 when the base part is screwed onto the neck.

The capsule 604 includes two mobile parts 617*a* and 617*b* on either side of the base part 606, the two mobile parts being substantially symmetrical relative to a median plane passing through the axis X of the container. The mobile parts 617*a* and 617*b* are connected to the base part 606 by hinges 626*a* and 626*b*, in particular film hinges, situated at the upper end of the mobile parts. The mobile parts 617*a* and 617*b* can be caused to rotate about an axis passing through these hinges and perpendicular to the axis X. They can be held in the closed position on the base part 606 for example by snap action.

Each mobile part 617*a* and 617*b* has an opening 618*a* and 618*b* formed at its lower end. Each opening 618*a* and 618*b* is closed by a cap 622*a* and 622*b* configured to be held for example by snap action on the mobile part 617*a* and 617*b* so as to close off the opening 618*a* and 618*b* in the recess in the "open" and "closed" positions.

When the mobile parts 617*a* and 617*b* are snapped onto the base part 606, as can be seen in FIG. 10, the caps 622 are closed and they are positioned against the shoulder of the bottle. Access to the recesses 616*a* and 616*b* is thus concealed partly by the base part 606 but also by the bottle.

When the user wishes to apply the second or the third product P2 or P3, she causes one or other of the mobile parts 617*a* or 617*b* to pivot about the hinges 626*a* or 626*b* thereby revealing the caps 622*a* or 622*b* and rendering them accessible. All that is then required is to remove the cap in order to gain access to the product.

In this embodiment, each cap 622*a* and 622*b* carries an applicator 623*a* and 623*b*.

Instead of being connected to the base part 706 by hinges, the mobile parts 717*a* and 717*b* can be detachably fixed on the base part 706 by a rib which fits into a groove. In an embodiment illustrated in FIG. 11, each mobile part 717*a* and 717*b* can include a rib 730 extending, over part of its height, parallel to the axis X when the capsule is in the closed position. The rib 730 is T-shaped in transverse cross-section. It is configured to slide in a groove 731 of counterpart shape provided on the base part 706, as can be seen in FIG. 13. The mobile parts are thus able to slide in the grooves 731 until they are fully detached from the base part 706. One will choose dimensions of the ribs and the grooves so that there are sufficient frictions between the two parts to prevent that the mobile parts do not disunite the base part under the effect of the simple gravity, while allowing the sliding of the mobile parts when the user wishes to take them.

In this embodiment, one of the mobile parts 717*b* can be identical to that illustrated in FIG. 10, i.e. it can incorporate an opening 718*b* at its lower end closed by a cap 722*b*, the cap carrying an applicator 723*b*.

When the base part 717*b* is caused to slide in the groove 731 by moving it away from the bottle, the shoulder of the bottle no longer conceals the cap 722*b* which becomes accessible so that it can be removed from the opening 718*b*.

The second mobile part 717*a* of the capsule 704, illustrated in FIG. 12, includes in this instance an opening 718*a* delineated at the upper end of the mobile part. It is closed by a flap 722 formed on the side of the mobile part that faces the base part 706 when the mobile part is mounted on the base part, above the rib 730. The flap is configured to pivot about an axis perpendicular to the lengthwise axis of the rib, just above the latter, in the manner of a pourer. The product P2 contained in the recess 716*a* can thus be taken up without an applicator.

When the mobile part 717*a* is attached to the base part 706, as can be seen in FIG. 11, the flap is closed and it positioned against the base part 706. Access to the recess 716*a* is thus concealed by the upper portion of the base part 706.

It is simply necessary to slide the base part 717*a* in the groove 731 away from the bottle to reveal the flap 722 so that it can be pivoted in order to pour the product P2.

In a variant of a capsule illustrated in FIGS. 14 and 15, the mobile part 817 can include a lateral opening 818 formed on the side of the mobile part facing the base part 806 when the mobile part is mounted on the base part, above the rib 830. The opening 818 is, for example, delineated by a tubular skirt which can be closed by a cap 822 screwed onto the skirt. The base part 806 of the capsule includes a thinner upper end 807 against which the cap 822 is positioned when the mobile part is mounted on the base part. The cap 822 opens on an axis perpendicular to the axis of the rib so that when the mobile part 817 is mounted on the base part, the cap cannot be unscrewed because it is concealed by the thinner portion 807 of the base part.

When the capsule includes two mobile parts, it is evident that they can each move independently from the closed position, in which access to the recess is concealed, to the open position in which the opening in the recess is accessible. The products P2 and P3 can be identical or different.

For example, the first and/or second and/or third products can be a powder, pressed or otherwise, a cream, a gel, and may or may not incorporate solid bodies such as flakes and/or pigments, for example mother-of-pearl.

The first, second and third products, respectively contained in the container and in the recess(es), can be complementary, that is to say designed to be applied simultaneously or successively on the same area to be treated. The colour of the second and/or third product can be different from that of the first product. One of the products can be a make-up or a skin care product and the other a product designed to modify the colour and/or the texture of the first product, thereby matching its colour to a particular skin tone or to a particular make-up for example.

The second and third products can be placed in the recess for example by pouring into the latter or by being formed in a cup fitted into the recess.

Throughout the description, the expression "including one" should be regarded as synonymous with "including at least one", unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A packaging and dispensing device comprising:

a container holding a first product, a closure capsule including a base part configured to detachably close off the container, wherein the closure capsule includes a mobile part defining a recess, said recess containing a second product, an opening in the recess being closed off by a cap, such that the mobile part can assume, relative to the base part, a closed position wherein the cap is rendered inaccessible by the base part and the mobile part is held in position on the base part by a connection component of the mobile part that cooperates with the base part independently from the cap, and an open position wherein the cap is accessible, wherein the device further comprises at least one of:

a first applicator designed to be held in the container, when the container is closed by said base part, and/or a second applicator in the recess.

2. A device according to claim 1, comprising said first applicator designed to be held in the container, when the container is closed by said base part.

3. A device according to claim 1, comprising said second applicator in the recess.

4. A device according to claim 3, wherein the second applicator is carried by the cap.

5. A device according to claim 1, wherein the mobile part is connected by a film hinge to the base part.

6. A device according to claim 1, wherein the mobile part is detachable relative to the base part.

7. A device according to claim 1, wherein the cap is detachable relative to the mobile part.

8. A device according to claim 1, wherein the cap includes a sealing means for closing said recess in a leaktight manner.

9. A device according to claim 1, wherein the second product is fluid.

10. A device according to claim 9, wherein said second product is a powder or a liquid.

11. A device according to claim 1, wherein the cap includes grasping means concealed between the base part and the mobile part when the closure capsule is in the closed position.

12. A packaging and dispensing device comprising:

a first container with a bottom and a wall defining an opening for said first container;

a first cap configured to close said opening for said first container;

a second container with a bottom and wall defining an opening for said second container; and a second cap configured to close said opening for said second container, wherein said first and second containers are coupled to each other in a first position, wherein, in said first position, said first cap closes said opening of said first container, said second cap closes said opening of said second container, and said first container is connected to said second container via a connection component that directly connects to both of the first cap and the second container, wherein the second cap is distinct and independent from the connection component such that, in said first position, the second cap does not directly contact the first cap, and wherein, in said first position, when said device rests with said bottom of said first container on a flat surface, said bottom of said first container is positioned below said opening of said first container and said bottom of said second container is positioned above said second cap and said opening of said second container, wherein the device further comprises at least one of:

a first applicator coupled to said first cap and with a first application portion inside said first container when said first cap closes said opening for said first container, and/or a second applicator coupled to said second cap and with a second application portion inside said second container when said second cap closes said opening for said second container.

13. A device according to claim 12, wherein said first and second containers are coupled to each other so as to be movable from said first position to a second position, wherein, in said second position, when said device rests with said bottom of said first container on said flat surface, said bottom of said first container is positioned below said opening of said first container and said bottom of said second container is positioned below said opening of said second container.

14. A device according to claim 13, wherein, in said second position, said second cap is exposed.

15. A device according to claim 14, wherein, in said second position, said first cap is exposed.

16. A device according to claim 13, wherein, in said first position, said second cap is not exposed.

17. A device according to claim 15, wherein, in said first position, said second cap is not exposed.

18. A device according to claim 13, wherein said first and second containers are decoupled from each other in said second position.

19. A device according to claim 13, wherein said first container includes a first product held by gravity by said bottom of said first container in said first position, when said device rests with said bottom of said first container on said flat surface, and wherein said second container includes a second product held by gravity by said second cap, which closes said opening of said second container in said first position, when said device rests with said bottom of said first container on said flat surface.

20. A device according to claim 19, wherein said first product is held by gravity by said bottom of said first container in said second position, and wherein said second product is held by said bottom of said second container in said second position.

21. A device according to claim 19, further comprising said first applicator coupled to said first cap and with said first application portion in contact with said first product in said first position, and said second applicator coupled to said second cap and with said second application portion not in contact with said second product in said first position.

22. A device according to claim 21, wherein said first applicator portion of said first applicator is in contact with said first product in said second position, and wherein said second application portion of said second applicator is in contact with said second product in said second position.

23. A device according to claim 19, further comprising said second applicator coupled to said second cap and with said second application portion not in contact with said second product in said first position, and wherein said second application portion is in contact with said second product in said second position.

24. A device according to claim 1, wherein the cap is arranged in the mobile part such that, when the mobile part assumes the open position wherein the cap is accessible, the cap remains in a position that closes off the recess of the mobile part, and the mobile part remains connected to the base part.

25. A device according to claim 12, wherein, in said first position, the second cap is inaccessible, and wherein said first and second containers are coupled to each other so as to be movable from said first position to a second position, wherein, in said second position, the second cap is accessible and remains in a position that closes off said opening for said second container, and said second container remains connected to the first container.

26. A device according to claim 1, wherein the connection component is a resiliently deformable tongue that snaps into a counterpart groove on an inner surface of the base part.

* * * * *